US006986318B2

(12) United States Patent
Sawyer

(10) Patent No.: US 6,986,318 B2
(45) Date of Patent: Jan. 17, 2006

(54) SAIL ASSEMBLY

(76) Inventor: Evelyn S. Sawyer, 76 Pine St., Freeport, ME (US) 04032

( * ) Notice: Subject to any disclaimer, the term of this patent is extended or adjusted under 35 U.S.C. 154(b) by 0 days.

(21) Appl. No.: 10/922,612

(22) Filed: Aug. 19, 2004

(65) Prior Publication Data

US 2005/0045085 A1 Mar. 3, 2005

Related U.S. Application Data

(60) Provisional application No. 60/499,093, filed on Aug. 29, 2003, provisional application No. 60/534,560, filed on Jan. 6, 2004.

(51) Int. Cl.
*B63H 9/04* (2006.01)

(52) U.S. Cl. ..... 114/102.1; 114/102.11

(58) Field of Classification Search ..... 114/102.1, 114/102.11

See application file for complete search history.

(56) References Cited

U.S. PATENT DOCUMENTS

| | | | | |
|---|---|---|---|---|
| 1,859,178 | A * | 5/1932 | Sprinkle | 280/810 |
| 4,082,049 | A * | 4/1978 | Nicol | 114/39.22 |
| 5,289,792 | A | 3/1994 | Forrest et al. | |
| 5,377,607 | A * | 1/1995 | Ross | 114/39.12 |
| 6,390,013 | B1 | 5/2002 | Cornell | |
| 6,457,430 | B1 | 10/2002 | Drabkin | |
| 6,615,758 | B2 | 9/2003 | Blad | |
| 6,655,314 | B2 | 12/2003 | Housely et al. | |
| 6,776,115 | B1 | 8/2004 | DeMeo | |
| 6,807,919 | B1 * | 10/2004 | Thomsen | 114/39.12 |

OTHER PUBLICATIONS

"QuiverSail." www.quiversail.com. QuiverSail, Inc. Site accessed Sep. 8, 2004.
"Spirit Sail." www.spiritsails.com. Spirit Sails Ltd. Site accessed Sep. 8, 2004.
"Zephyr Kayak Sails." www.seakayaksails.com. Zephyr Kayak and Sails. Site accessed Sep. 8, 2004.
"Kayak Sails and Canoe Sails by EZ V-Sail." www. vsail. com. EZ V-Sail. Site accessed Sep. 8, 2004.

* cited by examiner

*Primary Examiner*—Stephen Avila
(74) *Attorney, Agent, or Firm*—IP Strategies

(57) ABSTRACT

A sail assembly includes a sail, a mast, a coupler, and a fastener. The mast is attached to a first side of the sail. The coupler is attached to the mast and is used to couple the mast to a handle portion of a paddle. The fastener is attached to the sail at a location opposite the first side of the sail and is used to fasten the sail to the blade portion of the paddle. The sail is held in an open position when the mast is coupled to the handle portion of the paddle at a right angle to the paddle and the sail is fastened to the blade portion of the paddle. Thus, when the mast is supported upright and the end of the sail is connected to the paddle, the sail is open and usable to propel the boat under power of the wind.

45 Claims, 5 Drawing Sheets

SAIL ASSEMBLY

CROSS-REFERENCE TO RELATED APPLICATIONS

This is related to, and claims priority from, U.S. Provisional Patent Application No. 60/499,093, which was filed on Aug. 29, 2003. This is also related to, and also claims priority from, U.S. Provisional Patent Application No. 60/534,560, which was filed on Jan. 6, 2004.

FIELD OF THE INVENTION

The invention relates to means for propelling kayaks, canoes, rowboats, and other types of boats. More particularly, the invention relates to apparatus for providing sail power to a boat that is not usually equipped with a sail.

BACKGROUND OF THE INVENTION

Although kayaks, canoes, and other types of boats are normally propelled by a paddle, there are many times when it would be beneficial to use a sail to provide supplemental or effortless propulsion. A number of devices have been designed to provide sailing capability for kayaks. These include attachments to the kayak for a mast on which to attach the sail, two separate hulls used as bases for the sails, and sails held by or secured to the operator. There are drawbacks associated with using these devices. For example, they require complex attachment mechanisms or modifications to the kayak, or the operator must use his or her hands or body to hold the sail, therefore restricting use of the paddle. The devices are also somewhat large and unwieldy, and therefore do not lend themselves to spontaneous use after a period of time spent paddling.

It would be advantageous to provide a sail apparatus for kayaks, canoes, and rowboats that uses one or more collapsible masts and sails that can be attached to the paddle for use as well as for convenient storage when not in use. It would also be advantageous to provide a sail apparatus that includes a sail on either side of a kayak, to act similarly to outriggers and add stability to the kayak while in use.

BRIEF SUMMARY OF THE INVENTION

The present invention is a sail assembly for a kayak, canoe, row boat, or any other type of water-borne vessel. The sail assembly is compact, and assembles or disassembles quickly. When open, the sail assembly provides a surface that can catch the wind in order to propel the boat forward. When closed, the sails are furled and the masts are removed or fold flat against the paddle or oar, so there is no need to stow the sail anywhere on the boat.

A sail assembly according to the present invention includes a sail, a rigid support member, a coupler, and a fastener. The rigid support member, such as a mast, is attached to the sail at a first side of the sail. The coupler is attached to the rigid support member and is adapted to couple the rigid support member to a first portion of an elongated member, such as a canoe paddle, kayak paddle, boat oar, or other rigid pole fixed in position in the boat for the purpose of supporting the sail assembly. The fastener is attached to the sail at a location opposite the first side of the sail and is adapted to fasten the sail to a second portion of the elongated member. The sail is held in a substantially open position when the rigid support member is coupled to the first portion of the elongated member at a substantially right angle to the elongated member and the sail is fastened to the second portion of the elongated member. Thus, when the mast is supported upright and the end of the sail is connected to the paddle, the sail is open and usable to propel the boat under power of the wind.

The sail can be made of material including rip-stop nylon, Dacron® (or other synthetic fiber yarn), or any other suitable sail material, and can include a reinforced border. Preferably, the sail is substantially triangular in shape, and this shape can include a cut-out portion that follows the outline of a paddle blade. The sail assembly can include an auxiliary fastener, attached to the sail at an intermediate location between the main fastener and the coupler, to fasten the sail to an intermediate portion of the elongated member, such as at an edge of the cut-out portion.

The rigid support member can be, for example, a metal or carbon fiber rod and can be attached to an upper location of the sail at a top portion of the rigid support member. Accordingly, the top portion of the rigid support member and the upper location of the sail can include respective mating connectors. For example, the top portion of the rigid support member can include a rigid curved portion and the upper location of the sail can include a fabric loop that mates with the rigid curved portion.

The sail can be coupled at a bottom location of the sail to the coupler. For example, the sail assembly can include a clasp, and the bottom location of the sail can include an aperture coupling the clasp, such that the clasp provides coupling to the coupler. The coupler can include, for example, an eyebolt, to which the clasp can be coupled. The clasp can be, for example, a spring-clasp having a corded end that passes through the aperture, or a carabiner. The periphery of the aperture is preferably reinforced by a grommet.

The sail assembly can also include a cord and a cord stay. The cord is attached at a first end to a top portion of the rigid support member and at a second end to the cord stay. The cord stay is adapted to attach the second end of the cord to a stay point on the elongated member. The first portion of the elongated member is located between the stay point and the second portion of the elongated member. The cord stay can be, for example, an eyebolt.

The coupler can include, for example, a bracket adapted to surround the elongated member at the first portion, and a sleeve, coupled to the bracket, that engages a bottom end of the rigid support member. Preferably, the bottom end of the rigid support member is disposed within the sleeve, and the sleeve is pivotally coupled to the bracket. The interior portion of the bracket describes a cylinder, or a substantially cylindrical shape, having a longitudinal axis. This longitudinal axis is preferably aligned with the axis of the elongated member when the bracket is in place. The sleeve can be pivotally coupled to the bracket such that the rigid support member is disposed in either of at least an open position and a closed position; in the open position, the rigid support member is disposed at a substantially right angle with respect to the longitudinal axis (and therefore with the elongated member, when the bracket is in place), and in the closed position, the rigid support member is disposed to be substantially aligned with the longitudinal axis (and therefore with the elongated member, when the bracket is in place). Preferably, the sail is furled when the rigid support member is disposed in the closed position. The sail assembly can include ties that are adapted to attach the rigid support member and the furled sail to the elongated member when the rigid support member is disposed in the closed position. The ties can include hook and loop fasteners.

The coupler sleeve can include an eyelet, and the coupler can also include a pin that is attached to the bracket through the eyelet to pivotally couple the sleeve to the bracket. The pin can be at least partially threaded, and the coupler can also include a nut that mates with the pin to maintain connection of the pin to the bracket. To facilitate the connection, the bracket can include tabs having apertures through which the pin is disposed.

The fastener can include a clasp coupled to an aperture disposed at the location opposite the first side of the sail. For example, the clasp can be a spring-clasp having a corded end that passes through the aperture, or a carabiner. Preferably, a grommet reinforces the periphery of the aperture.

The coupler can be adapted to couple the rigid support member to the first portion of a rigid pole fixed in a generally transverse orientation within a water-borne vessel, and the fastener can be adapted to fasten the sail to the second portion of the rigid pole. For example, a boat of any type can be fitted with a rigid pole, or a passenger in the boat can hold such a pole. The couple can couple the mast to a central portion of the pole, and the fastener, such as a clamp, clip, or cord, can fasten the end of the sail to an outer portion of the pole.

The coupler can be adapted to couple the rigid support member to a handle end of a single-bladed paddle for a water-borne vessel, and the fastener can be adapted to fasten the sail to an aperture located at the blade of the paddle. For example, the sail assembly can be attached to a canoe paddle or rowboat oar. The coupler can be coupled to the handle end of the oar, and a hole can be drilled in the blade to accommodate the fastener. Thus, a passenger can hold the oar across his or her knees, or in an oarlock, to make use of the sail assembly for propelling the boat across a lake or other body of water.

The coupler can be adapted to couple the rigid support member to a central portion of a double-bladed paddle for a water-borne vessel, and the fastener can be adapted to fasten the sail to an aperture located at a first blade of the paddle. For example, the sail assembly can be attached to a kayak paddle. The coupler can be coupled at the central portion of the paddle, and a hole can be drilled one of the blades to accommodate the fastener. Thus, a passenger can hold the paddle across his or her knees, or in a paddle yoke, to make use of the sail assembly for propelling the kayak across a lake or other body of water.

In the case of a double-sided paddle such as a kayak paddle, or using two single-sided oars, the sail assembly can include two sets of the described components, preferably arranged in mirror image, to take greater advantage of the wind. That is, the sail assembly can also include a second sail, a second rigid support member, a second coupler, and a second fastener. The second rigid support member is attached to the second sail at a first side of the second sail. The second coupler is attached to the second rigid support member and is adapted to couple the second rigid support member to the central portion of, for example, the double-bladed paddle. The second fastener is attached to the second sail at a location opposite the first side of the second sail and is adapted to fasten the second sail to an aperture located at a second blade of the paddle. The second sail is held in a substantially open position when the second rigid support member is coupled to the central portion of the double-bladed paddle and the second sail is fastened to the aperture located at the second blade of the paddle. For extra stability, the first rigid support member can be coupled to the second rigid support member. For example, the sail assembly can also include a length of shock cord, attached to each of the first and second rigid support members, preferably between top portions of the first and second rigid support members.

Alternatively, a single rigid support member and couple can be used with dual sails. The second sail can be attached at a first side of the second sail to the rigid support member.

According to any of the embodiments described above, the sail can include one or more transparent panels, which provides visibility through the sail to the operator. The transparent panel can be tinted, or coated in order to reduce glare.

DETAILED DESCRIPTION OF THE INVENTION

In the following description, the words "paddle" and "oar" are used interchangeably to mean a shaft having a blade at one end or both ends, used to manipulate water to propel a boat. The word "boat" is used generically to mean any watercraft or other water-borne vehicle, regardless of whether it is normally propelled by the use of a paddle, such as a canoe, kayak, or rowboat.

Figure 1:
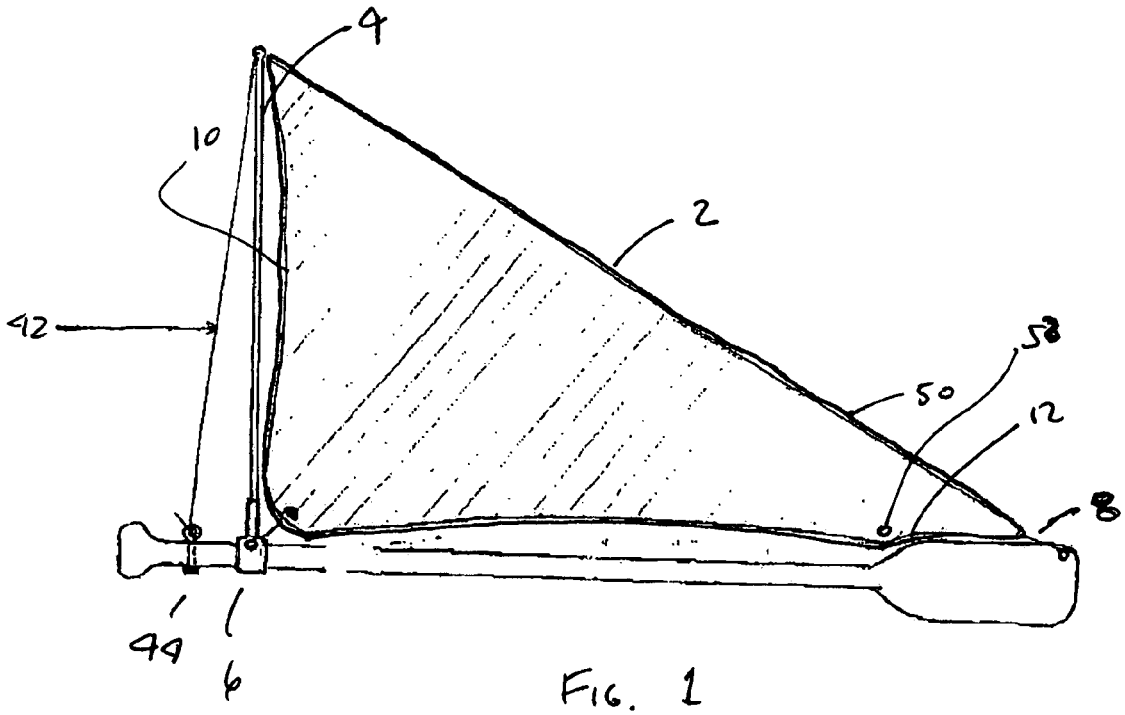
FIG. 1 is an illustration of an exemplary embodiment of the present invention, attached to a single-bladed paddle.

FIG. 1 shows an exemplary embodiment of the present invention. As shown, the sail assembly includes a sail 2, a mast 4, a coupler 6, and a sail fastener 8. The mast 4 stands upright from the oar or paddle when the sail is deployed, and supports the upright side 10 of the sail 2. The coupler 6 holds the mast 4 upright and in place with respect to the oar, and preferably is able to slide over the shaft of the oar so that the position of the mast 4 can be advantageously adjusted. The sail fastener 8 is attached to the sail at the far end of the sail, opposite the mast side 10 and fastens the sail 2 to the blade or other end portion of the oar. If a long pole or other construction is used instead of an oar or paddle, the sail fastener 8 can be attached over the end of the pole, or by some other mechanism to a distal portion of the pole.

The sail 2 can be made of any durable sheet material, including such typical sail fabrics as rip-stop nylon or Dacron®, and can include a reinforced border 50. Preferably, the sail 2 is substantially triangular in shape. As shown, this triangular shape can include a cut-out portion 12 that follows the outline of a paddle blade. FIG. 1 shows a paddle blade in a vertical orientation; however, the sail assembly of the present invention is also contemplated for use with a paddle blade held in a horizontal orientation.

Figure 2:
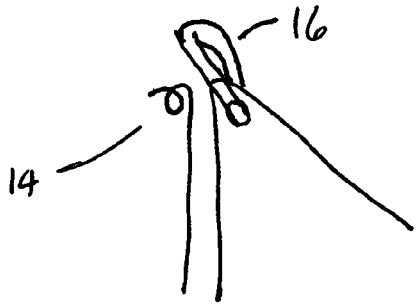
FIG. 2 is an illustration of an exemplary mating connection of the upper mast and sail of the present invention.

The mast 4 can be made of any rigid material, and preferably is a metal or carbon fiber rod, made of a material that is resilient enough to bend slightly when necessary under the force of a full sail. Other rigid materials, such as fiberglass and wood, are suitable for use as mast material. The mast can be fabricated as a unitary construction, or can be made of connected segments that fold or telescope. Preferably, the top of the mast 4 is attached in a fixed manner to the top of the mast side 10 of the sail 2 by respective mating connectors. For example, as shown in FIG. 2, the top portion of the mast 4 can include a rigid curved portion 14 and the upper end of the sail 2 can include a fabric loop 16 that mates with the rigid curved portion 14. When placed in the rigid curved portion 14, the loop 16 is captured, but still has some freedom of movement around the fixed point.

Figure 3:
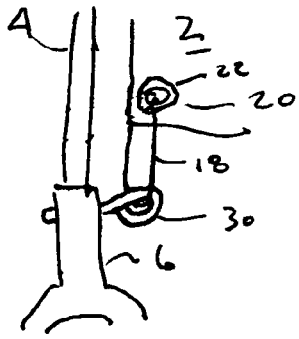
FIG. 3 is an illustration of an exemplary mating connection of the lower mast and sail of the present invention.

Preferably, the bottom of the mast side of the sail 10 is attached to the coupler. For example, a clasp 18 can be used to attach the coupler 6 and the sail 2 through a hole 20 in the sail 2 and through an eyebolt 30 or other component of the coupler 6, as shown in FIG. 3. The clasp 18 can be, for example, a spring-clasp having a corded end that passes through the hole 20, or a carabiner. The periphery of the hole 20 is preferably reinforced by a grommet 22. Alternatively, the sail 2 can be attached to the mast 4 instead of the coupler 6, or can be attached directly to the oar.

Figure 4:
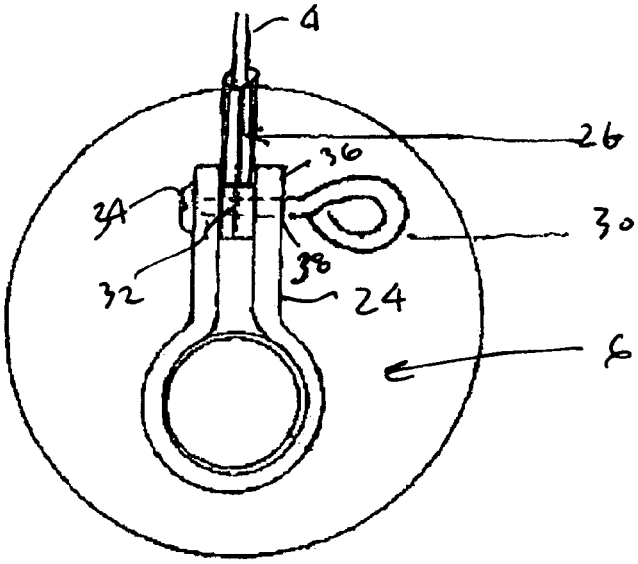
FIG. 4 is an illustration of an exemplary bracket of the present invention.
Figure 5:
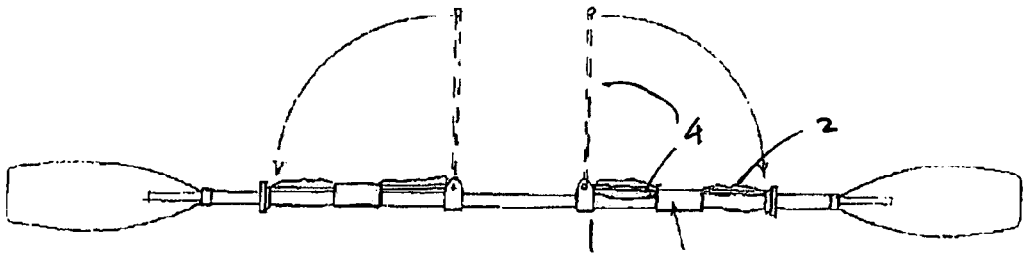
FIG. 5 is an illustration of an exemplary embodiment of the present invention, attached to a double-bladed paddle with the mast and furled sail secured to the paddle shaft.
Figure 6:
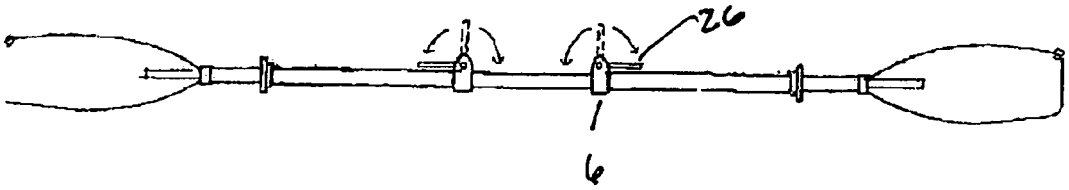
FIG. 6 is an illustration of an exemplary coupler of the present invention, attached to a double-bladed paddle.

As shown in FIG. 4, a preferred embodiment of the coupler 6 includes a bracket 24 surrounding the oar, and a sleeve 26, coupled to the bracket 24, that engages a bottom end of the mast 4. The bracket should provide a fit around the shaft of the oar that is tight enough to prevent slippage. The grip can be assisted by providing a hole through the bottom of the bracket, drilling a hole in the oar shaft, and driving a screw or bolt through the bracket hole into the hole in the oar shaft. The bottom end of the mast 4 is disposed within the sleeve 26, and the sleeve 26 is pivotally coupled to the bracket 24 so that the mast 4 can be disposed in any of a range of positions, including an open position, in which the mast 4 is upright with respect to the oar, and a closed position, in which the mast 4 is disposed against the oar. Thus, the sail 2 is deployed when the mast 4 is in the open position, and is furled when the mast 4 is in the closed position. In the closed position, the mast 4 and the furled sail 2 can be attached to the paddle shaft with ties 28, as shown on a double-bladed paddle embodiment in FIG. 5. The ties 28 can be, for example, straps that include a hook and loop closure, such as Velcro® strips. Alternatively, as shown in FIG. 6, the mast 4 and sail 2 can be removed when not in use, leaving the coupler 6 attached to the paddle shaft.

To provide the pivoting connection, the coupler sleeve 26 can include an eyelet 32, and the coupler 6 can also include a pin 30, such as an eye bolt, that is attached to the bracket 24 through the eyelet 32 to pivotally couple the sleeve 26 to the bracket 24, as shown in FIG. 4. The pin 30 can be at least partially threaded, and the coupler 6 can also include a nut 34 that mates with the pin 30 to maintain connection of the pin 30 to the bracket 24. To facilitate the connection, the bracket 24 can include tabs 36 having apertures 38 through which the pin 30 is disposed. Alternatively, the mast 4 can be connected directly to the bracket 24 using a similar eyelet/pin arrangement or other suitable pivoting connection. In such an embodiment, no sleeve 26 is needed, but the mast 4 is not so easily removed from the coupler 6 and therefore from the paddle shaft.

Figure 7:
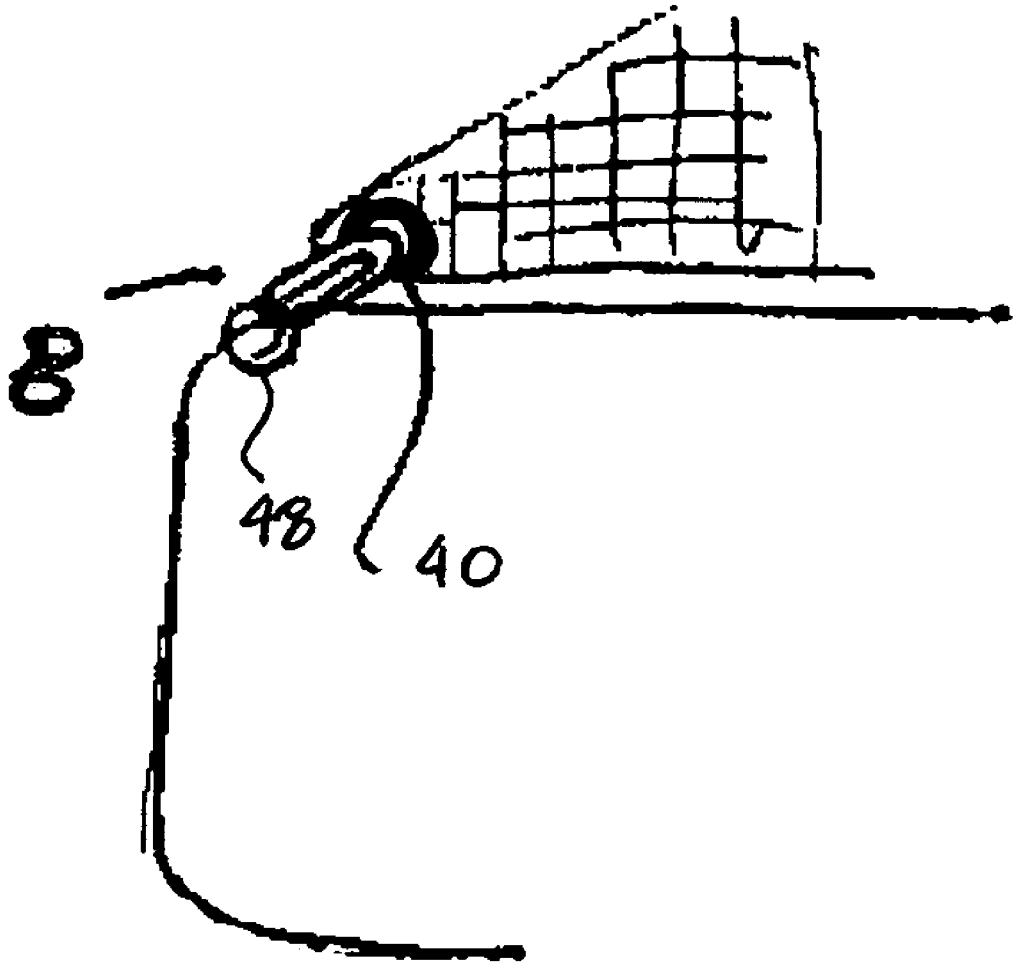
FIG. 7 is an illustration of an exemplary fastener of the present invention.

The sail fastener 8 is shown in more detail in FIG. 7. As shown, a hole has been drilled in the blade of the oar, and a split ring 48 has been inserted through the hole. A clasp, clip, snap hook, carabiner, or other sail fastener 8 connects the end of the sail 2 to the split ring, preferably through a grommet-reinforced hole 40 near the corner of the sail. As shown in FIG. 1, another hole 52 can be provided in the sail 2, to provide another connection point between the sail 2 and the paddle, particularly if the sail 2 includes a paddle-shaped cut-out 12. Through this hole, the sail 2 can be attached by clasp and split ring to another point of the paddle blade, or can be attached by clasp or cord to the paddle shaft, near the blade. With the sail fastener 8 in place and the mast 4 in the upright position, the sail 2 is deployed.

The sail assembly of the present invention can be attached to any rigid pole transversely spanning a boat. Any small boat can be fitted with such a pole, or the pole can be held by a passenger when the sail assembly is in use. Of course, certain boats use oars or paddles, and such cases a structure is already in the vessel that is suitable for use with the sail assembly.

For example, the coupler 6 can be attached to a handle end of a single-bladed oar for a boat such as a canoe or rowboat, and the sail fastener 8 can attach the sail 2 to an aperture located at the blade of the paddle, such as a hole drilled in the blade, or a split ring inserted through a drilled hole. For extra mast stability, this embodiment can include a back-stay cord 42, connected between the top of the mast and a location on the oar shaft that is closer to the handle end than is the coupler 6. Preferably, the back-stay cord 42 is made from a material having very little elasticity. The back-stay cord 42 can be connected to the oar shaft using any type of connector, such as, for example, an eyebolt 44 through the shaft. Using such an embodiment, a passenger can hold the oar across his or her knees, or in an oarlock, to make use of the sail assembly for propelling the boat across a lake or other body of water.

Figure 8:
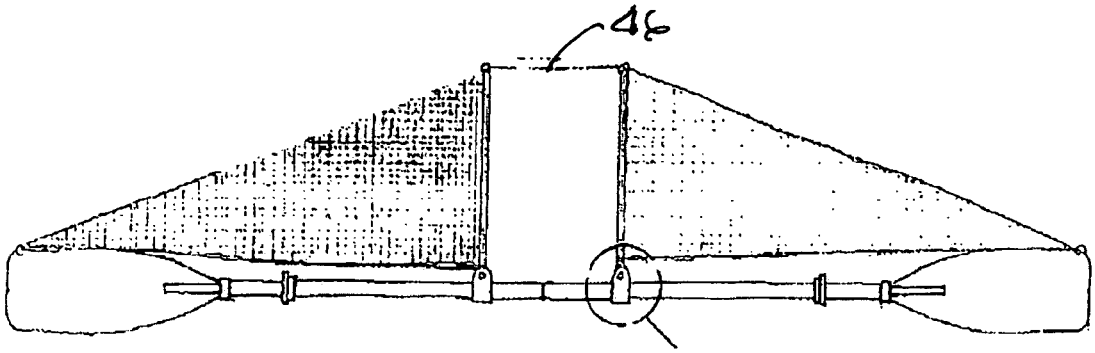
FIG. 8 is an illustration of an exemplary deployed sail of the present invention, attached to a double-bladed paddle.
Figure 9:
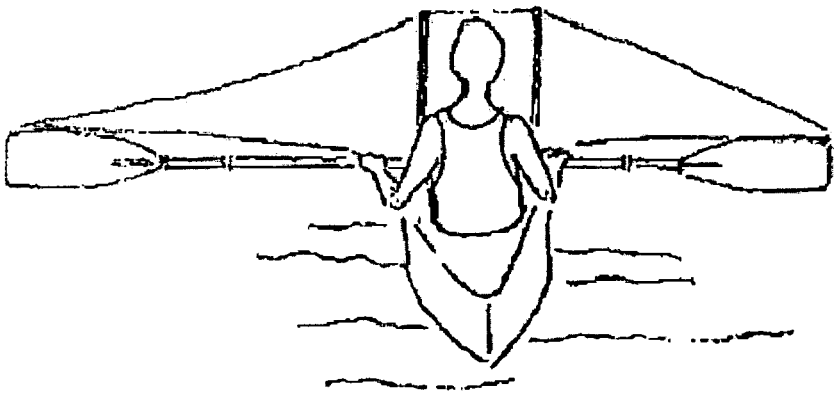
FIG. 9 is an illustration of use of an exemplary embodiment of the present invention.
Figure 10:
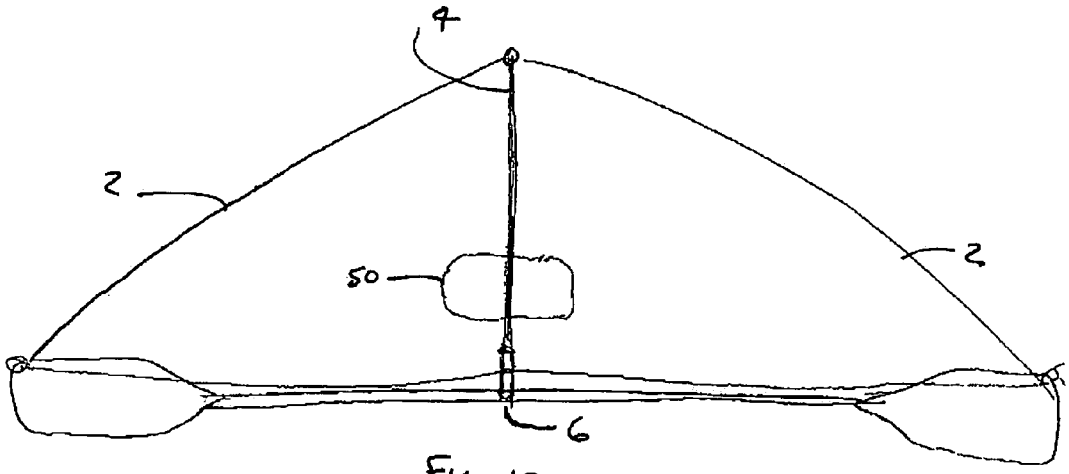
FIG. 10 is an illustration of an exemplary embodiment including a transparent panel.

Alternatively, the coupler 6 can be attached to the central portion of a double-bladed paddle for a kayak or similar vessel, and the fastener 8 can attach the sail 2 to an aperture located at a first blade of the paddle, such as a hole drilled in the blade, or a split ring inserted through a drilled hole. In such an embodiment, the sail assembly can include two sets of the described components, preferably arranged in mirror image, to take greater advantage of the wind. That is, the sail assembly can also include a second sail, a second mast, a second coupler, and a second sail fastener. The second mast, sail, coupler, and sail fastener are connected in a manner similar to that of the first group of components, preferably in symmetrical fashion about the masts, which are arranged in parallel, extending from the central portion of the paddle shaft. Thus, each sail is fastened at its end to one of the two paddle ends. For extra stability, the first mast can be coupled to the second mast. For example, as shown in FIG. 8, the sail assembly can also include a length of cord 46, such as shock cord, attached to each of the first and second masts, preferably between top portions of the masts. Preferably, the unstretched length of the connecting shock cord is slightly shorter than the distance between the masts. The assembly, attached to the kayak paddle, can be held by the passenger as the sail propels the kayak, as shown in FIG. 9. Alternatively, the two groups of sail components can share a single, central mast, as shown in FIG. 10.

Also as shown in this figure, one or both sails can include a transparent panel 50, through which the operator can see in order to guide the boat. This panel 50 can be tinted, or can be coated to reduce glare. The transparent panel 50 is shown at the edge of two sails sharing a common mast. However, the transparent panel 50 can be used with any of the embodiments described above, and can be disposed in a central portion of a sail or in any location that is most suitable to an operator of the boat.

Particular exemplary embodiments of the present invention have been described in detail. These exemplary embodiments are illustrative of the inventive concept recited in the appended claims, and are not limiting of the scope or spirit of the present invention as contemplated by the inventor.

For example, the side of the sail closest to the mast can include a sleeve, and the sail can be attached to the mast by slipping the sleeve over the mast, as an alternative attachment arrangement. Other alternatives are contemplated in which the masts and sails of the two-sail embodiment are not symmetrical. For example, in a two-mast, two-sail embodiment, one mast can be taller than the other mast, and the corresponding sail can be larger than the other sail. If the two sails share a mast, the attachment mechanism for the smaller sail can be located part of the way up the mast, rather than at the top of the mast. Further, in this or any other embodiment, the paddle or pole on which the sail assembly is arranged can be tiled at least somewhat from the transverse direction of the boat, so as to be used somewhat or entirely in a fore-and-aft sail arrangement.

I claim:

1. A sail assembly, comprising:

a sail, constructed of flat, flexible material;

a rigid support member, attached to the sail at a first side of the sail;

a coupler, attached to the rigid support member and adapted to couple the rigid support member to a first portion of an elongated member; and a fastener, attached to the sail at a location opposite the first side of the sail and adapted to fasten the sail to a second portion of the elongated member;

wherein the coupler includes a bracket adapted to surround the elongated member at the first portion, and a sleeve, coupled to the bracket, that engages a bottom end of the rigid support member; and wherein the sleeve is pivotally coupled to the bracket.

2. The sail assembly of claim 1, wherein the sail is made of fabric material including at least one of rip-stop nylon and synthetic yarn.

3. The sail assembly of claim 1, wherein the bottom end of the rigid support member is disposed within the sleeve.

4. The sail assembly of claim 1, wherein an interior portion of the bracket defines a cylinder having a longitudinal axis.

5. The sail assembly of claim 4, wherein the sleeve is pivotally coupled to the bracket such that the rigid support member can be disposed in either of at least an open position and a closed position, wherein the rigid support member is disposed at a substantially rigid angle with respect to the longitudinal axis when in the open position, and wherein the rigid support member is disposed to be substantially aligned with the longitudinal axis when in the closed position.

6. The sail assembly of claim 5, wherein the sail is furled when the rigid support member is disposed in the closed position.

7. The sail assembly of claim 6, further comprising ties that are adapted to attach the rigid support member and the furled sail to the elongated member when the rigid support member is disposed in the closed position.

8. The sail assembly of claim 7, wherein the ties include hook and loop fasteners.

9. The sail assembly of claim 1, wherein the coupler further includes a pin, the sleeve includes an eyelet, and the pin is attached to the bracket through the eyelet to pivotally couple the sleeve to the bracket.

10. The sail assembly of claim 9, wherein the pin is at least partially threaded.

11. The sail assembly of claim 10, wherein the coupler further includes a nut that mates with the pin to maintain connection of the pin to the bracket.

12. The sail assembly of claim 9, wherein the bracket includes tabs having apertures through which the pin is disposed.

13. The sail assembly of claim 1, wherein the fastener includes a clasp coupled to an aperture disposed at the location opposite the first side of the sail.

14. The sail assembly of claim 1, wherein the coupler is adapted to couple the rigid support member to a central portion of a double-bladed paddle for a water-borne vessel, and the fastener is adapted to fasten the sail to an aperture located at a first blade of the paddle.

15. The sail assembly of claim 1, wherein the sail is substantially triangular in shape.

16. The sail assembly of claim 15, wherein the substantially triangular shape includes a cut-out portion that follows the outline of a paddle blade.

17. The sail assembly of claim 16, wherein the fastener is a main fastener, further including an auxiliary fastener, attached to the sail at an intermediate location between the main fastener and the coupler and adapted to fasten the sail to an intermediate portion of the elongated member.

18. The sail assembly of claim 17, wherein the intermediate location is at an edge of the cut-out portion.

19. The sail assembly of claim 1, wherein the rigid support member is one of a metal rod and a carbon fiber rod.

20. The sail assembly of claim 1, wherein the rigid support member is attached to an upper location the sail at a top portion of the rigid support member.

21. The sail assembly of claim 20, wherein the top portion of the rigid support member and the upper location of the sail include respective mating connectors.

22. The sail assembly of claim 21, wherein the top portion of the rigid support member includes a rigid curved portion; and the upper location of the sail includes a fabric loop that mates with the rigid curved portion.

23. The sail assembly of claim 1, further comprising:

a cord; and a cord stay;

wherein the cord is attached at a first end to a top portion of the rigid support member and at a second end to the cord stay; and wherein the cord stay is adapted to attach the second end of the cord to a stay point on the elongated member;

such that the first portion of the elongated member is located between the stay point and the second portion of the elongated member.

24. The sail assembly of claim 23, wherein the cord stay is an eyebolt.

25. The sail assembly of claim 1, wherein the coupler is adapted to couple the rigid support member to the first portion of a rigid pole fixed in a generally transverse orientation within a water-borne vessel, and the fastener is adapted to fasten the sail to the second portion of the rigid pole.

26. The sail assembly of claim 1, wherein the coupler is adapted to couple the rigid support member to a handle end of a single-bladed paddle for a water-borne vessel, and the fastener is adapted to fasten the sail to an aperture located at the blade of the paddle.

27. A sail assembly, comprising:

a sail, constructed of flat, flexible material;

a rigid support member, attached to the sail at a first side of the sail;

a coupler, attached to the rigid support member and adapted to couple the rigid support member to a first portion of an elongated member; and a fastener, attached to the sail at a location opposite the first side of the sail and adapted to fasten the sail to a second portion of the elongated member;

wherein the sail is coupled at a bottom location of the sail to the coupler;

further including a clasp, wherein the bottom location of the sail includes an aperture coupling the clasp, and wherein the clasp is coupled to the coupler; and wherein the clasp is one of a spring-clasp having a corded end that passes through the aperture, and a carabiner.

28. The sail assembly of claim 27, wherein the sail is substantially triangular in shape.

29. The sail assembly of claim 28, wherein the substantially triangular shape includes a cut-out portion that follows the outline of a paddle blade.

30. The sail assembly of claim 29, wherein the fastener is a main fastener, further including an auxiliary fastener, attached to the sail at an intermediate location between the main fastener and the coupler and adapted to fasten the sail to an intermediate portion of the elongated member.

31. The sail assembly of claim 30, wherein the intermediate location is at an edge of the cut-out portion.

32. The sail assembly of claim 27, wherein the rigid support member is one of a metal rod and a carbon fiber rod.

33. The sail assembly of claim 27, wherein the rigid support member is attached to an upper location of the sail at a top portion of the rigid support member.

34. The sail assembly of claim 33, wherein the top portion of the rigid support member and the upper location of the sail include respective mating connectors.

35. The sail assembly of claim 34, wherein the top portion of the rigid support member includes a rigid curved portion; and the upper location of the sail includes a fabric loop that mates with the rigid curved portion.

36. The sail assembly of claim 27, wherein the coupler includes an eyebolt, and the clasp is coupled to the eyebolt.

37. The sail assembly of claim 27, further comprising:

a cord; and a cord stay;

wherein the cord is attached at a first end to a top portion of the rigid support member and at a second end to the cord stay; and wherein the cord stay is adapted to attach the second end of the cord to a stay point on the elongated member;

such that the first portion of the elongated member is located between the stay point and the second portion of the elongated member.

38. The sail assembly of claim 37, wherein the cord stay is an eyebolt.

39. The sail assembly of claim 27, wherein the coupler is adapted to couple the rigid support member to the first portion of a rigid pole fixed in a generally transverse orientation within a water-borne vessel, and the fastener is adapted to fasten the sail to the second portion of the rigid pole.

40. The sail assembly of claim 27, wherein the coupler is adapted to couple the rigid support member to a handle end of a single-bladed paddle for a water-borne vessel, and the fastener is adapted to fasten the sail to an aperture located at the blade of the paddle.

41. A sail assembly, comprising:

a sail, constructed of flat, flexible material;

a rigid support member, attached to the sail at a first side of the sail;

a coupler, attached to the rigid support member and adapted to couple the rigid support member to a first portion of an elongated member; and a fastener, attached to the sail at a location opposite the first side of the sail and adapted to fasten the sail to a second portion of the elongated member;

wherein the coupler is adapted to couple the rigid support member to a central portion of a double-bladed paddle for a water-borne vessel, and the fastener is adapted to fasten the sail to an aperture located at a first blade of the paddle;

wherein the sail is a first sail, the rigid support member is a first rigid support member, the coupler is a first coupler, the fastener is a first fastener, and the sail assembly further comprises:

a second sail;

a second rigid support member, attached to the second sail at a first side of the second sail;

a second coupler, attached to the second rigid support member and adapted to couple the second rigid support member to the central portion of the double-bladed paddle; and a second fastener, attached to the second sail at a location opposite the first side of the second sail and adapted to fasten the second sail to an aperture located at a second blade of the paddle.

42. The sail assembly of claim 41, wherein the first rigid support member is coupled to the second rigid support member.

43. The sail assembly of claim 42, further comprising a length of shock cord, attached to each of the first and second rigid support members.

44. The sail assembly of claim 43, wherein the shock cord is attached between top portions of the first and second rigid support members.

45. The sail assembly of claim 14, wherein the sail is a first sail, the fastener is a first fastener, an the sail assembly further comprises:

a second sail, attached at a first side of the second sail to the rigid support member; and a second fastener, attached to the second sail at a location opposite the first side of the second sail and adapted to fasten the second sail to an aperture located at a second blade of the paddle.

* * * * *